US005475963A

United States Patent [19]

Chelednik

[11] Patent Number: 5,475,963

[45] Date of Patent: Dec. 19, 1995

[54] METHOD AND DEVICE FOR REPAIRING VINYL SIDING

[76] Inventor: Robert Chelednik, 40 Chestnut St., Lakewood, N.J. 08701

[21] Appl. No.: 278,830

[22] Filed: Jul. 22, 1994

[51] Int. Cl.[6] ..... E04D 1/00

[52] U.S. Cl. ..... 52/545; 52/514; 52/547; 52/745.21; 52/748.11

[58] Field of Search ..... 52/547, 545, 748, 52/514, 518, 745.21

[56] References Cited

U.S. PATENT DOCUMENTS

| | | | |
|---|---|---|---|
| 2,766,861 | 10/1956 | Abramson | 52/545 X |
| 3,282,009 | 11/1966 | Chalmers | 52/545 X |
| 3,977,145 | 8/1976 | Dobby et al. | 52/521 X |
| 4,272,576 | 6/1981 | Britson | 52/545 X |
| 4,292,781 | 10/1981 | Chalmers et al. | 52/547 |
| 4,382,354 | 5/1983 | Gailey et al. | 52/521 |
| 4,411,117 | 10/1983 | Bolha | 52/521 |
| 4,672,788 | 6/1987 | Vautosh | 52/514 |
| 4,972,647 | 11/1990 | Meldrum | 52/518 |

*Primary Examiner*—Carl D. Friedman
*Assistant Examiner*—Christopher Todd Kent
*Attorney, Agent, or Firm*—Clifford G. Frayne

[57] ABSTRACT

A method and apparatus for securing disengaged, adjacent vinyl siding panels, the repair element having a generally planar body having a top edge of a thickness greater than the bottom edge, the planar body being slightly arcuate in shape, the top edge of the repair element being selectively frictionally engageable with a channel formed on the upper edge of a secured vinyl siding panel, the lower edge being engageable with the channel formed on the lower edge of the disengaged vinyl siding panel so as to resecure it to its adjacent vinyl siding panel.

3 Claims, 3 Drawing Sheets

METHOD AND DEVICE FOR REPAIRING VINYL SIDING

BACKGROUND OF THE INVENTION

1. Field of the Invention

This invention relates to the repair of vinyl or metal siding commonly used on houses, dwellings and commercial buildings and more particularly, to a method and novel device for resetting siding panels which have become dislodged after installation.

2. Description of the Prior Art

The use of aluminum or vinyl siding is quite common and popular in establishing a maintenance-free exterior for homes, dwellings and commercial buildings. The original popularity with respect to the use of vinyl or metal siding is with respect to older homes, however, it is becoming increasingly more acceptable to utilize vinyl or metal siding on new home construction.

The siding is produced in elongated strips or panels which are nailed or secured to the house along one of their longitudinal edges with the opposing longitudinal edge overlapping and interlocking with the panel positioned immediately beneath it. In this manner, the installer commences the installation proximate to the foundation and works his way upwardly to the roof line.

A problem that is often encountered with siding of this nature is the shrinkage or settlement of the building or house whether it be new construction or old construction, such that the overlapping interlock between adjacent panels becomes disengaged allowing the disengaged panel to flap against the house during windy conditions. Additionally, extreme temperature differentials may cause the panels to expand or contract which may also contribute to the problem.

Several attempts have been made to develop solutions to this problem. The obvious early solution was to affix the lower longitudinal edge of the panel back to the wall by driving a trim nail through the lower portion. This proved unsatisfactory since the siding panels have to maintain their ability to expand and contract and the use of nails or adhesives defeated this ability and caused the siding panels to take on a ripple effect which was aesthetically displeasing. Further, the use of trim nails to secure the lower longitudinal edge of the disengaged panel would in most instances void any warranties given by the installer with respect to the panels as it would constitute improper installation. Another solution to the problem which was both costly and time-consuming was to remove the siding panels and reinstall them.

A variety of mounting methods have been developed with respect to this type of siding and include, but are not limited to, U.S. Pat. Nos. 3,738,076; 3,824,756; 4,054,012; 4,096,679; 4,272,576; 4,348,849; 4,382,354; 4,424,655; 4,435,933; 4,672,788; 4,698,942; 4,854,101; 4,947,609 and 5,150,555. None of the aforementioned patents with the exception of U.S. Pat. No. 4,672,788 address the particular problem of quickly and inexpensively repairing panels which have become disengaged after installation.

Van Tosh in U.S. Pat. No. 4,672,788 developed a clip which would be nailed to the exterior wall of the building, slightly above the upper longitudinal edge of the lower panel and which would engage the upper longitudinally running hook of the upper edge of the secured panel so as to in effect provide an extension of this hook downwardly so that it would engage the corresponding hook on the lower longitudinal edge of the panel that had become disengaged. The problem associated with Van Tosh's solution is that the panel must be lifted upwardly to gain access to the underlying wall in order to secure the clip and some guesswork is required with respect to positioning the clip at the proper height so as to therefore cause the proper downward extension of the hook for engagement with the hook of the disengaged panel. Applicant has developed a much simpler solution adaptable to the current type of siding panels utilized in the industry which allows for the quick and inexpensive method for re-engaging adjacent panels of siding.

OBJECTS OF THE INVENTION

It is an object of the present invention to provide for a simple and inexpensive method of repairing siding panels which have become disengaged due to settling and/or temperature differentials.

It is a further object of the present invention to provide for a simple and inexpensive device for reengaging adjacent siding panels which have become disengaged as a result of settling or temperature differentials.

It is a still further object of the present invention to provide for a novel and inexpensive device and method which will reengage disengaged siding panels without the necessity of or utilization of a fiber intrusive securing means.

SUMMARY OF THE INVENTION

An expansion clip for the reengagement of disengaged adjacent siding panels, the clip having a first edge crimped so as to present a multi-layered edge conformable with and frictionally engageable with the upper locking member of a piece of vinyl siding, a panel member extending downwardly from said crimped edge, to a second edge, said second edge biased with respect to the first edge, the length of the panel and the positioning of the second edge selectively adjustable such that the second edge engages the lower locking element of the disengaged siding panel thereby resecuring it to the lower siding panel while still allowing the vinyl siding to move freely and react to temperature differentials.

BRIEF DESCRIPTION OF THE DRAWINGS

These and other objects of the present invention will become evident particularly when taken in light of the following illustrations wherein.

DETAILED DESCRIPTION OF THE DRAWINGS

Figure 1:
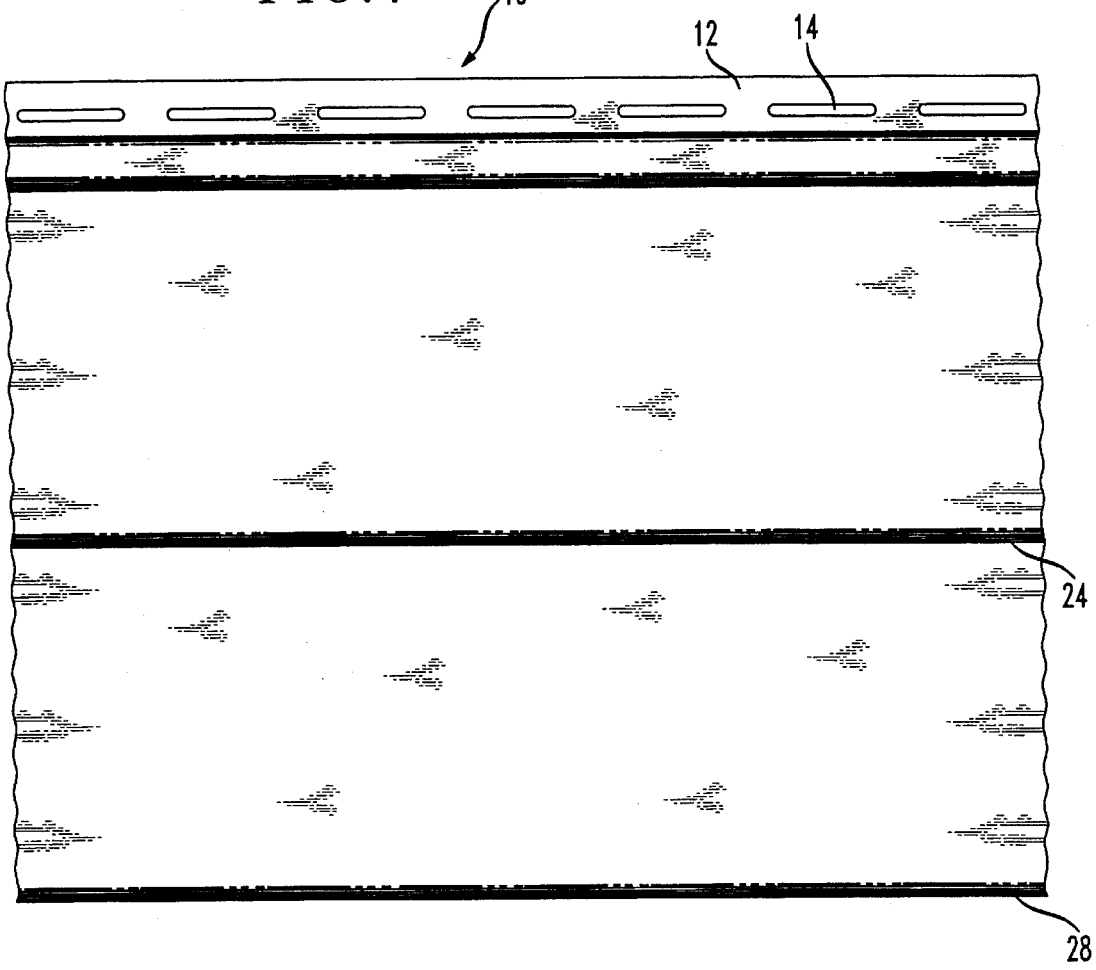
FIG. 1 is a front view of a portion of a typical piece of siding panel.
Figure 2:
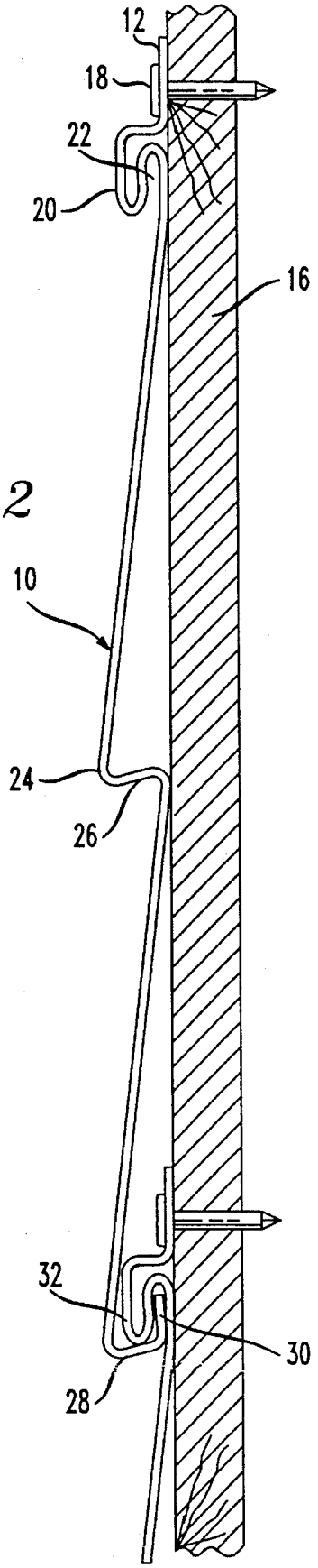
FIG. 2 is a side view of a typical installation of two adjacent siding panels.

FIG. 1 illustrates a front view of a portion of vinyl or metal siding. A typical piece of siding is an elongate strip which is manufactured to resemble one or two rows of wood siding or clapboard. The siding panel 10 illustrated in FIG. 1 is designed to resemble two rows of wood siding or clapboard. Siding panel 10 has a planar upper edge 12 which is meant to mount flush with the outer wall or side of the house or structure to which it is being installed. Upper edge 12 may have a plurality of apertures 14 positioned therein to accommodate a securing means in the form of mounting nails or the like which secure the panel to the exterior surface of the house or structure. From upper edge 12, siding panel 10 then extends downwardly forming a series of loops which are best illustrated with respect to FIG. 2 which is a side view of a typical siding panel 10. In FIG. 2, it can be seen that upper edge 12 is secured flush with the wall of the structure 16 by means of securing means 18 which, in this instance, consists of siding nails. Proceeding downwardly in a sequential fashion, siding panel 10 forms a loop 20 immediately below upper edge 12, this loop forming a channel 22 which extends for the length of the panel member and is normally referred to in the trade as the top lock. Channel 22 which is longitudinal and extends the length of the panel member has a neck 21 whose width is less than the with of channel 22. Siding panel 10 then extends downwardly with a slight outward curvature until it forms a second loop 24 and channel 26 which serve as a demarcation point for establishing the resemblance of two pieces of wood siding or clapboard as the case may be. The panel member then continues downwardly and slightly arcuately outwardly to its bottom edge 28 where it turns under forming a hook-like member 30 and longitudinal channel 32 which extend for the length of the lower edge of siding panel 10.

Lower hook portion 30 and channel portion 32 are designed to engage the top lock portion formed by loop 20 and channel 22 of the siding panel immediately below. Lower hook portion 30 is of the same thickness as the rest of a typical siding panel 10 and is designed to slide through neck 21 and be in contact with the top of loop 20, at which time, the second siding panel would be secured along its edge 12 by means of a securing means 18. This is illustrated in FIG. 2 wherein an identical siding panel 10 is shown installed against the outer wall 16 of the house or structure and hook 30 and channel 32 are cooperable with the top lock to engage the two adjacent siding panels.

In application, the lower siding panel illustrated in FIG. 2 might be the first siding panel installed along the lowermost portion of the frame of the structure. The installers would then move upwardly engaging hook 30 and channel 32 of the next siding panel with the top lock of the lower, secured siding panel and securing the subsequent siding panel. In this fashion, the installer would move upwardly from the lower frame edge to the roof line.

Figure 3:
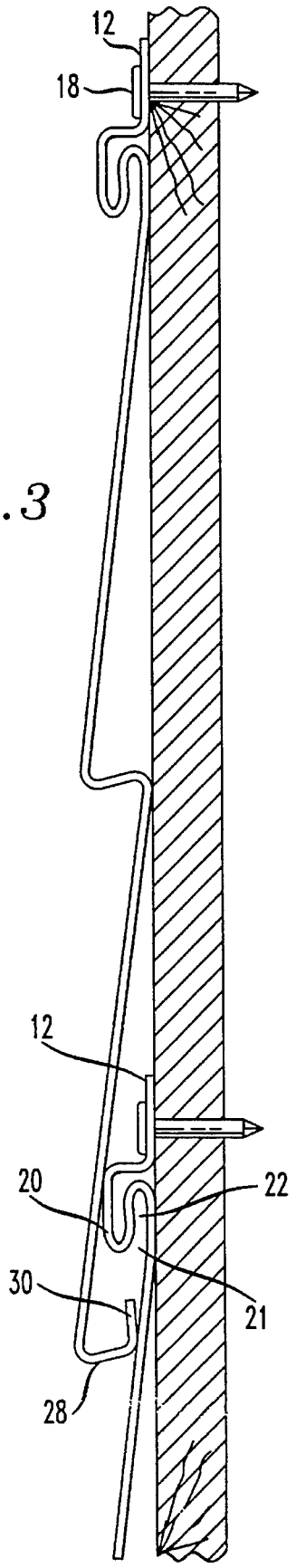
FIG. 3 is a side view illustrating the disengagement of two adjacent siding panels as a result of settling or temperature differentials.

As a result of the problems discussed heretofore, adjacent siding panels oftentimes become disengaged with the result illustrated in FIG. 3 which is a side view of a typical disengagement between two adjacent siding panels.

Lower edge portion 28 of siding panel 10, having become disengaged from the top lock portion of the siding panel positioned immediately below it, would flap in the wind, cause noise, and disrupt the aesthetics of the house or structure. To drive a nail through or proximate to the lower edge 28 of the disengaged siding panel 10 would reattach it to the house, but would void any warranties and would prevent the siding panel 10 from moving or expanding on its own to react to temperature differentials. The result would be a ripple effect in the siding panel which would again disrupt the aesthetics. Applicant's invention comprises an expansion clip which is easily installed and requires no securing means which would be intrusive to the wall of the structure and the siding panel 10.

Figure 4:
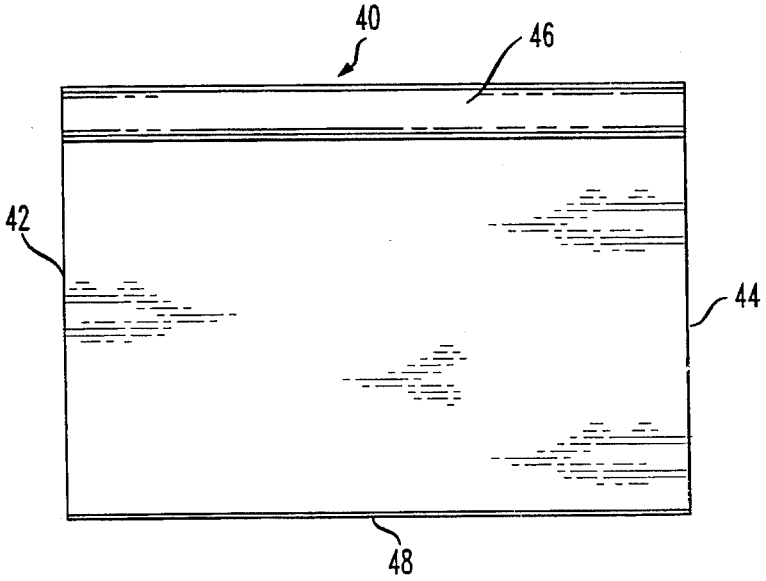
FIG. 4 is a front view of the expansion clip which is the subject of the present invention.
Figure 5:
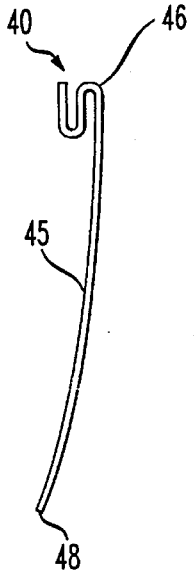
FIG. 5 is a side view of the expansion clip which is the subject of the present invention.

FIG. 4 illustrates a front view of the Applicant's expansion clip and FIG. 5 a side view. The expansion clip 40 is generally rectangular in shape having parallel side edges 42 and 44, a top edge 46 and a lower edge 48. Top edge 46 is thicker than the remaining portion of the expansion clip 40 and has a side cross-sectional area equal to the cross-sectional area of channel 22 as formed by the top lock on the siding panel 10. Top edge 46 of expansion clip 40 is wider than neck 21 of channel 22 and therefore can be snap-fit through neck 21 into channel 22 to secure it in position. Top edge 46 of expansion clip 40 is designed to frictionally engage in a snap-fit manner into channel 22. Lower end portion 48 of expansion clip 40 is somewhat biased with respect to top edge 46 in that there is a degree of convex curvature 45 between the two edges.

In the preferred embodiment, expansion clip 40 has a width of approximately 2" and a length of approximately 2½". In its simplest construction, a flat piece of aluminum siding conforming to those dimensions could be crimped along one 2" edge to form the top edge 46 of expansion clip 40. The aluminum can then be slightly bent to impart a convex curvature between top edge 46 and lower edge 48. A plurality of such expansion clips 40 would then be utilized in spaced apart relationship of approximately 2 feet between the adjacent expansion clips 40 to reattach or reengage the siding panel as illustrated in FIG. 5. Expansion clips 40 are of sufficient strength, such that when snap-fit into channel 22 through neck 21, that they can secure the dislocated panel member in position even in the event of high winds.

Figure 6:
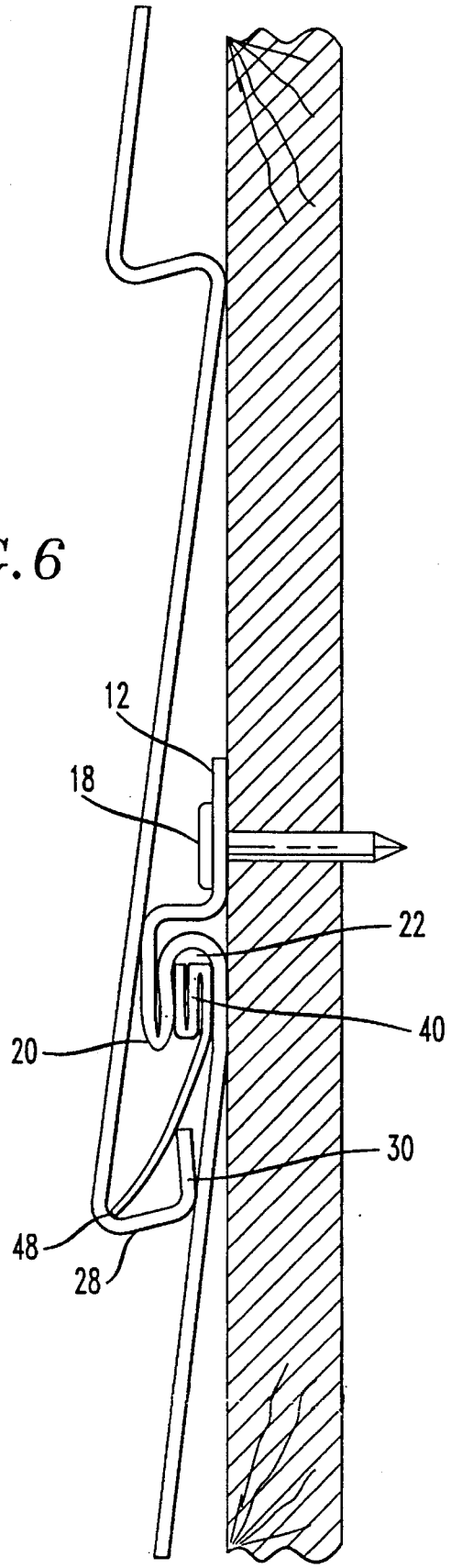
FIG. 6 is a side view showing the manner in which the expansion clip is secured and utilized to reengage the disengaged panel member.

FIG. 6 illustrates the disengagement of a siding panel and the manner in which expansion clip 40 is utilized to quickly and easily reattach the disengaged member to the siding member positioned immediately beneath the disengaged member.

Expansion clip 40 would be urged under the disengaged siding panel and snap fit into channel 22. This step would be repeated at 2 foot intervals along the length of the siding panel. The length of the expansion clip 40 would be designated on the expansion clip by drawing a line where the lowest portion of the disengaged siding panel was positioned. The length of expansion clip 40 would then be adjusted by clipping off the excess portion along lower edge 48. Expansion clip 40 would then be snap fit secured into channel 22 and the installer would move along the siding panel and utilizing a vinyl zip tool would urge hook-like member 30 over lower edge 48 of expansion clip 40 such that lower edge 48 became engaged in longitudinal channel 32, thus resecuring the disengaged member to the member below it. No adhesives or fiber intrusive devices are required and the vinyl siding retains its ability to expand and contract and move as well as being returned to an aesthetically-pleasing condition.

While the present invention has been described in connection with the exemplary embodiment thereof, it will be understood that many modifications will be apparent to those of ordinary skill in the art and that this application is intended to cover any adaptations or variations thereof. Therefore, it is manifestly intended that the invention be only limited by the claims and the equivalents thereof.

What is claimed is:

1. The method of repairing housing siding of the type in which an array of siding panels which have been secured to a housing wall in overlapping relationship and where at least one panel has become disengaged from an adjacent panel as a result of a hook-shaped portion along the lower edge of said disengaged panel having shifted downwardly and having become disengaged from a cooperation hook-shaped portion on the upper edge of the underlying panel, comprising:

inserting beneath the lower edge of said disengaged panel and into the channel formed by said cooperative hook-shaped portion of said underlying panel, a repair element having an upper edge frictionally engageable with said channel and in snap fit engagement therewith and having a lower edge disposed from said upper edge, a distance sufficient to extend below said hook-shaped portion of said disengaged panel;

marking the correct length of said repair element by scoring a line utilizing said lower edge of said disengaged panel as a guide;

removing said repair element from said snap fit engagement;

cutting along said scored line to remove the excess length of said repair element;

reinserting said repair element into frictional, snap fit engagement with said channel of said underlying panel;

fitting said hook-shaped portion of said lower edge of said disengaged panel over the lower edge of said repair element.

2. The method in accordance with claim 1 wherein said method is repeated sequentially at predetermined intervals along the path of disengagement of said siding panels.

3. In combination with a pair of like, adjacent siding panels each of which is secured adjacent its upper edge to a housing wall one above the other with each having an upwardly hook-shaped portion along their lower edge and a downwardly-depending hook-shaped portion along their respective upper edge, said upwardly facing hook-shaped portion cooperable with said downwardly-depending hook-shaped portion of said adjacent panel, a repair element for reengaging adjacent panels having become disengaged, comprising:

a generally planar body having a top edge, a bottom edge and opposing side edges, said top edge having a thickness generally greater than said bottom edge, said thickness and cross-section of said top edge substantially equal to a channel formed by said downwardly-depending hook-shaped portion along said upper portion of said panel, said top edge and said bottom edge of said repair element being biased in convex curvature such that said bottom edge extends outwardly from said housing wall, said bottom edge of said repair element engageable with said upwardly-extending hook-shaped portion on said lower edge of said disengaged panel thereby reengaging said panels.

* * * * *